United States Patent [19]

Buse et al.

[11] 3,997,418

[45] Dec. 14, 1976

[54] ELECTROPHORETIC COATING

[75] Inventors: Kenneth E. Buse, New Kensington; Raymond J. Meyer, Apollo, both of Pa.

[73] Assignee: Aluminum Company of America, Pittsburgh, Pa.

[22] Filed: Nov. 9, 1972

[21] Appl. No.: 304,916

[52] U.S. Cl. ..... 204/181; 204/299 EC; 204/DIG. 7

[51] Int. Cl.[2] ..... C25D 13/12; C25D 13/22

[58] Field of Search ..... 204/181, 299 EC, 300 EC, 204/DIG. 7, 212, 224 R

[56] References Cited

UNITED STATES PATENTS

| | | | |
|---|---|---|---|
| 3,361,658 | 1/1968 | Tanner | 204/181 |
| 3,399,126 | 8/1968 | Turner | 204/299 |
| 3,650,932 | 3/1972 | Turner | 204/181 |

FOREIGN PATENTS OR APPLICATIONS

| | | | |
|---|---|---|---|
| 1,388,465 | 9/1965 | France | 204/DIG. 7 |
| 986 | 1896 | United Kingdom | 204/DIG. 7 |

*Primary Examiner*—T. M. Tufariello
*Attorney, Agent, or Firm*—John P. Taylor

[57] ABSTRACT

Electrophoretic coating of small ware such as metal fasteners or rivets.

4 Claims, 3 Drawing Figures

ELECTROPHORETIC COATING

BACKGROUND OF THE INVENTION

1. Field of the Invention

This invention relates to electrophoresis. More particularly, it relates to electrophoretic coating of small ware such as metal fasteners, particularly aluminum rivets, by conducting the same through a flowing coating medium.

2. Description of the Prior Art

Electrophoretic coating of small articles, as taught, for example, by U.S. Pat. No. 3,361,658, has become quite popular in recent years. Nevertheless, it has met with problems, for example, inconsistent and non-uniform painting or coating of odd-shaped or uneven-shaped objects, especially rounded objects such as metal fasteners which have rounded heads, including arcuate and semicircular or part circular contours when considered in cross section. By semicircular or part circular herein we refer to any surface which may comprise at least a portion of the circumference of a circle when viewed in a single plane. In electrophoretic coating, usually one or more moving belts or lines of the objects to be coated, electrically charged, pass beneath a nozzle, likewise but oppositely charged, through which the coating medium, for example, a polymer or copolymer is discharged. Any excess coating medium falling or removed from the objects being coated according to such a process may be conducted to a reservoir from which the coating material, usually in the form of an aqueous dispersion, may be passed to the nozzle. Unfortunately, however, the aforementioned problems of inconsistent and non-uniform or uneven coating are encountered when the coating material such as paint or lacquer is not applied uniformly, for example, where a rounded object is coated more thickly toward the center than toward the periphery or edge thereof.

SUMMARY OF THE INVENTION

After extended investigation we have found that this problem of inconsistent and non-uniform coating can be remedied by use of a nozzle having a configuration at its discharge portion, i.e., the surface or vicinity where the coating substance exits in flowing form, approximating that of the cross sectional configuration of the item to be coated, for example, that of a semicircular or part circular shape as viewed in a single plane, when the objects to be electrophoretically coated are the heads of round head rivets, which are more or less hemispherically shaped.

While we do not wish to be bound by any particular theory as to why this arrangement produces a more uniform coating than those experienced heretofore, it may be because the potential gradient across the electrocoating medium is more nearly the same.

BRIEF DESCRIPTION OF THE DRAWINGS

For a better understanding of our invention reference will now be made to the drawings, which form a part hereof:

In the drawings:

In FIG. 1, a simple, straight-type nozzle comprises a metal body 10, solution inlet 12, cathode lead 14 and spray exit 16. A stream or curtain of liquid medium flows from exit 16 to coat the head surface 20 of anodic rivet 22. Electric current passes in the pattern shown at 18.

Figure 2:
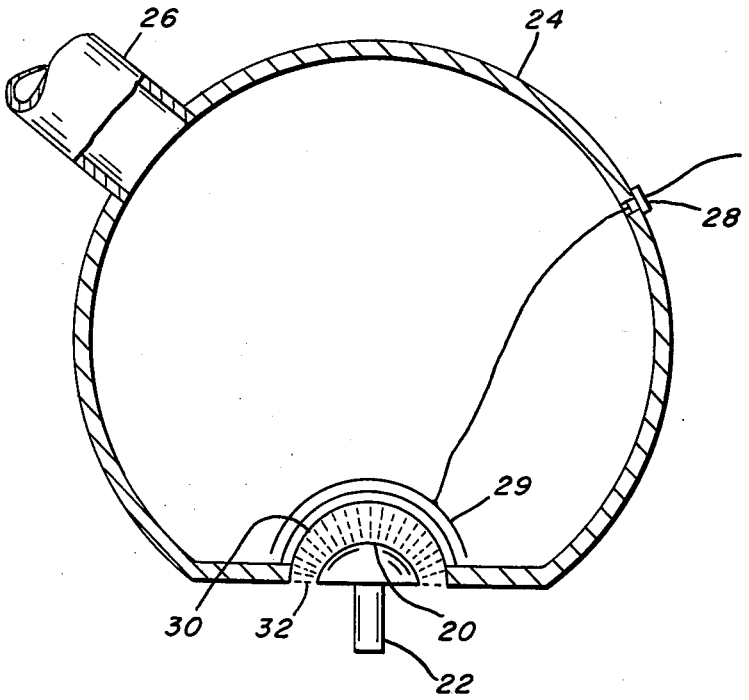
FIG. 2 is a cross section of a contoured nozzle useful according to the invention, showing also a rivet being coated thereby.

The nozzle of FIG. 2, useful according to the invention, may be made up of plastic body 24, solution inlet 26, cathode lead 28, semicircularly contoured wire mesh cathode 29, and non-conductive perforated shield 30. Coating medium discharge 32 proceeds in the contoured pattern against the semicircular head surface 20 of anodic rivet 22.

Figure 3:
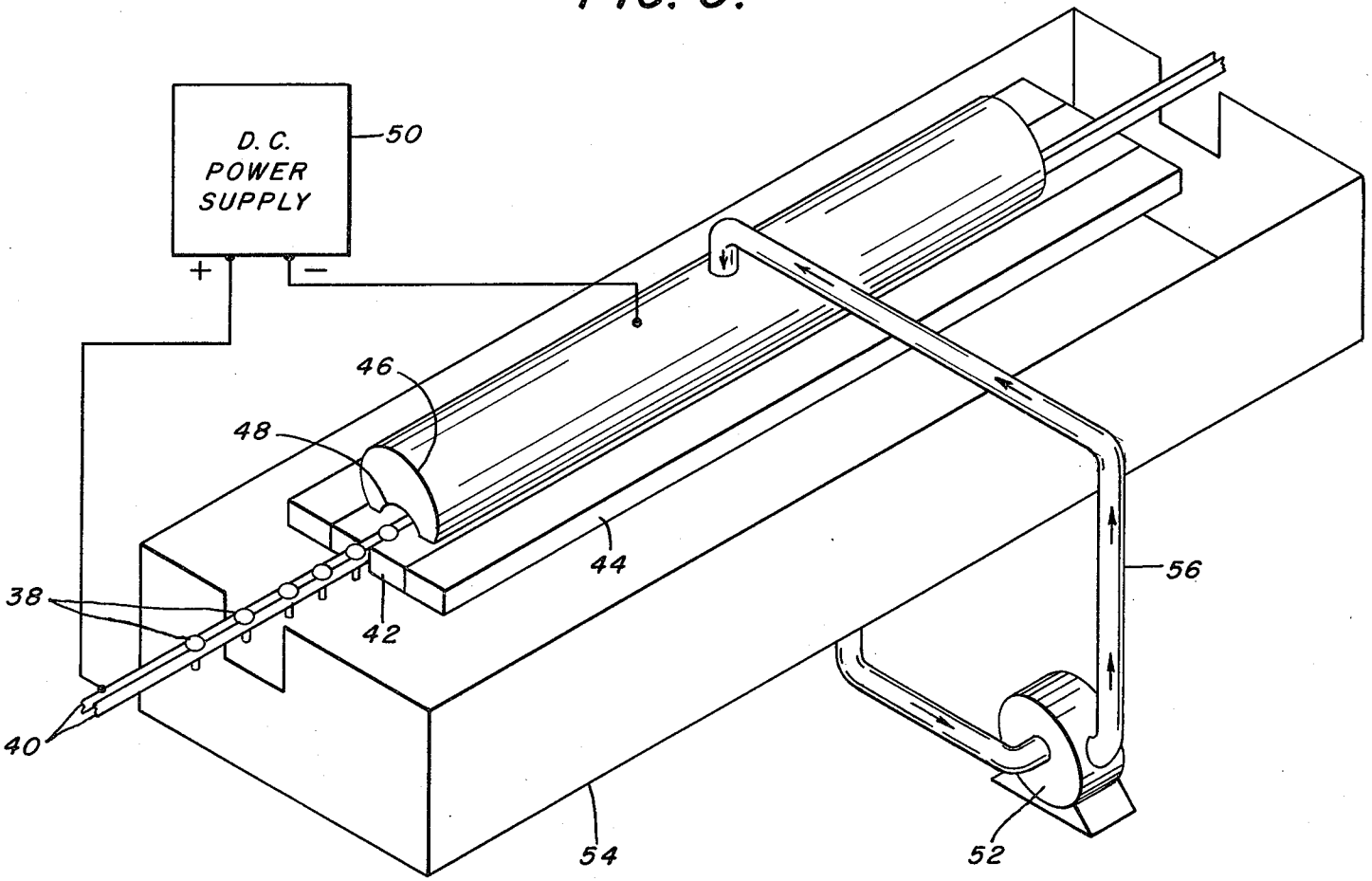
FIG. 3 is a perspective view illustrating the various parts of the electrophoretic spray process of the invention.

In FIG. 3, rivets 38 are conducted along parallel twin-belt conveyor 40, and are held in line by continuous pressure spring 42 and adjustable back-up bar 44 beneath nozzle 46, which has a semicircularly configured discharge portion or surface 48, a metal mesh, for directing coating on the heads of rivets 38 as they pass thereunder. The contoured mesh constituting the discharge surface 48 of nozzle 46 is negatively charged, and the parallel twin-belt conveyor 40, which is in electrical contact with rivets 38 is placed at ground potential. Power comes from DC power supply 50. Pump 52 circulates coating material from reservoir 54 via line 56 to nozzle 46.

DESCRIPTION OF THE PREFERRED EMBODIMENT

Figure 1:
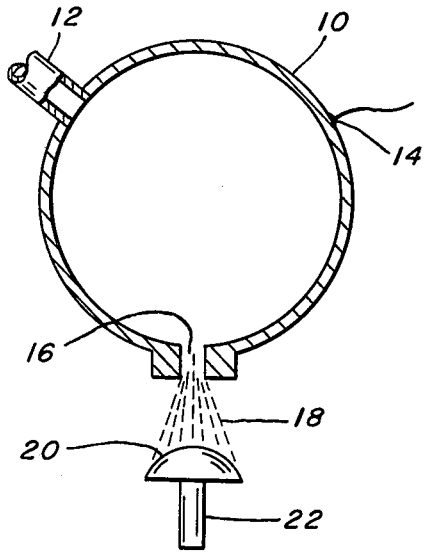
FIG. 1 is a schematic cross section of a simple nozzle having a straight, rather than a contoured, configuration at the discharge portion or outlet thereof. Also depicted is a rivet being coated.

The following example is illustrative of the invention. In this example a comparison is made between use in electrophoretic flow coating of a configured, here semicircular, nozzle representative of the invention and use of a simple straight-type nozzle. The table which follows contains the electrophoretic spray coating conditions and resultant film thickness measurements for a number of 3/16-inch brazier head rivets painted or enamelled using two different nozzles, one resembling that depicted in FIG. 1 (simple nozzle) and the other that of FIG. 2 (the invention). The simple nozzle consisted of a 1.5-inch diameter aluminum tube with a 12-inch long, 1/8-inch wide slot opening along its entire length. The entire nozzle served as cathode. An electrocoating enamel dispersion was pumped through the tube and exited as a 12-inch long liquid curtain, through which ½-inch diameter rivet heads were passed and coated upon application of an electric charge. The crowned heads of the rivets thus coated had 10–40% more paint at the center than at the periphery. A band of coating was noted across the heads of the rivets approximately in line with the direction of the impinging fluid curtain.

The contoured nozzle, here semicircular, used in this comparision to demonstrate improved electrophoretic coating according to the invention, was 3-feet long, the cathode being curved in a semicircular manner to conform substantially to the configuration of and more or less surround the rivet heads, giving a substantially uniform anode to cathode spacing between most parts of or points on the nozzle emission surface and rivet heads. The nozzle used here was a polyvinyl chloride (PVC) tube with an integral perforated interior cathode formed over the convex inside surface of a smaller perforated half-tube which formed a tunnel-like channel, as illustrated in FIG. 2 of the drawing. The head surfaces of rivets coated by using this improved nozzle had visually uniform appearances. This uniformity of coating is verified by thickness measurements for four randomly selected rivets, as recorded in the table herein. For these four samples, the overall average thickness was 0.00104 inch of paint deposited in 4 seconds at 400 volts. Under similar conditions (400 and 420 volts), using the straight-type nozzle, a typical thickness at the center of the head of the rivet of only about 0.0008 inch was achieved in 6 seconds. Thus, the use of the improved contoured, e.g., semicircular, nozzle according to the invention effected approximately a 20% increase in film thickness, the film being deposited in approximately 33 percent less time than that required according to the non-contoured nozzle procedure to deposit the thinner film.

TABLE

| Sample No. | Electrophoretic Coating Conditions Temp. (° F) | Potential (Volts) | Dwell Time (sec.) | Nozzle | Avg. Film Thickness (In.) Center | Edge |
|---|---|---|---|---|---|---|
| 1 | 70 | 420 | 6 | Straight | 0.00066 | 0.00050 |
| 2 | 90 | 420 | 6 | Straight | 0.00127 | 0.00088 |
| 3 | 90 | 420 | 4 | Straight | 0.00059 | 0.00035 |
| 4 | 90 | 420 | 3 | Straight | 0.00038 | 0.00032 |
| 5 | 90 | 200 | 6 | Straight | 0.00048 | 0.00027 |
| 6 | 90 | 300 | 6 | Straight | 0.00066 | 0.00045 |
| 7 | 90 | 400 | 6 | Straight | 0.00078 | 0.00060 |
| 8 | 70 | 200 | 6 | Straight | 0.00041 | 0.00026 |
| 9 | 70 | 300 | 6 | Straight | 0.00074 | 0.00077 |
| 10 | 70 | 400 | 6 | Straight | 0.00070 | 0.00066 |
| 11 | 70 | 420 | 6 | Straight | 0.00082 | 0.00065 |
| 12 | 80 | 400 | 4 | Contoured | 0.00097 | |
| 13 | 80 | 400 | 4 | Contoured | 0.00114 | |
| 14 | 80 | 400 | 4 | Contoured | 0.00105 | |
| 15 | 80 | 400 | 4 | Contoured | 0.00101 | |

While the invention has been described in terms of a preferred embodiment, the claims appended hereto are intended to encompass all embodiments which fall within the spirit of the invention.

Having thus described our invention and a preferred embodiment thereof, we claim:

1. A process for electrophoretic coating which comprises conducting electrically charged round head metal fasteners beneath at least one oppositely charged nozzle having a part circular shaped discharge portion and passing a current between said nozzle and said fasteners while flowing a coating medium from said discharge portion of said nozzle onto said surface of said fasteners to be coated, thereby coating the same substantially uniformly with said coating medium.

2. In a process for electrophoretic coating of metal fasteners which comprises coating same with a flow of a coating substance by conducting said coating substance from an electrically charged nozzle to oppositely charged surfaces of the heads of said fasteners, the improvement which comprises employing a semicircular-shaped surface on said nozzle, thereby directing said flow substantially evenly over said surfaces of said heads of said fasteners and producing a coating thereon of substantially uniform thickness.

3. The improvement of claim 2 wherein the metal fasteners are aluminum rivets and the coating substance comprises an aqueous dispersion of a coating polymer.

4. A process for uniform electrophoretic spray coating which comprises: passing a current between a surface of a part circular shaped object and an electrode comprising a nozzle having a portion contoured to the shape of at least a portion of the surface of said object while flowing a coating medium from said contoured electrode onto said surface of said shaped object, thereby providing a uniform coating on said object.

* * * * *